US005277632A

United States Patent [19]

Davis

[11] Patent Number: 5,277,632

[45] Date of Patent: Jan. 11, 1994

[54] BOAT MOTOR REPLACEMENT SKEG

[76] Inventor: Richard D. Davis, 1062 Terrace Ct., Zanesville, Ohio 43701

[21] Appl. No.: 18,261

[22] Filed: Feb. 16, 1993

[51] Int. Cl.[5] ..... B63H 5/12

[52] U.S. Cl. ..... 440/71; 29/402.01; 440/78

[58] Field of Search ..... 114/140; 441/79; 440/76, 78, 71; 29/889.1, 402.01, 402.09, 402.14

[56] References Cited

U.S. PATENT DOCUMENTS

| | | | |
|---|---|---|---|
| 2,021,309 | 11/1935 | Irgens | 440/78 |
| 2,429,774 | 10/1947 | Schultz | 440/78 |
| 4,161,056 | 7/1979 | Dunham | 29/402.09 |
| 4,995,840 | 2/1991 | Seale et al. | 440/66 |
| 5,007,868 | 4/1991 | Fry | 440/71 |
| 5,007,869 | 4/1991 | Zoellner | 440/71 |

FOREIGN PATENT DOCUMENTS

| | | | |
|---|---|---|---|
| 0071689 | 6/1981 | Japan | 29/889.1 |

*Primary Examiner*—Sherman Basinger
*Attorney, Agent, or Firm*—Frank H. Foster

[57] ABSTRACT

An outboard motor replacement skeg which is thin and flat and has a cavity formed in one of its edges is disclosed. The replacement skeg is slid over the stub which remains after the original skeg is broken off, and is fastened to the skeg stub with silicone sealant and rivets. As an alternative, the replacement skeg may be part of an original design to replace a specific breakaway skeg having a particular mounting structure.

9 Claims, 2 Drawing Sheets

BOAT MOTOR REPLACEMENT SKEG

TECHNICAL FIELD

The invention relates generally to the field of boat motor attachments, and more specifically to the field of boat motor attachments for repairing or replacing a previously existing boat motor appendage.

BACKGROUND ART

All outboard motors and outdrive units have a downwardly directed fin attached to the lowest extremity of the motor, below a rounded housing which contains a propeller drive shaft, i.e. the lower unit. The fin, which is commonly called a skeg, provides lateral stability and steering capability to the motor, and protection of the propeller from contact with submerged objects.

If the motor lower unit strikes an object, either when the boat is in the water or being trailered, the skeg is usually the first part of the motor to make contact. Ideally, the contact between the skeg and the object will cause the motor to pivot upwardly about an axis significantly above the skeg and propeller, causing the motor to pivot out of harm's way. However, this contact between the skeg and the object frequently causes a portion of the skeg to be broken off or bent. Attempts at repositioning a bent skeg result in breakage of the skeg, which is a casting. Most frequently, only a portion of the skeg is broken off, leaving behind a stub. Skegs are designed to fracture preferentially to prevent more extensive and expensive damage to gears, shafts and bearings which are higher in the motor housing. When the skeg has been broken away from the motor the steering is less sure, the propeller is more vulnerable to fracture, and the torque effect makes steering more difficult.

Conventionally, skeg repairs involve either replacing the entire lower unit or welding a new fin-shaped plate onto the remaining portion of the skeg. When the lower unit is replaced, the operation is expensive (ranging from $400.00 to $1200.00), dependent upon motor size (i.e. H.P.). If a new, typically aluminum, skeg is welded onto the housing, the cost is usually less than replacing the lower unit. Welders willing to work aluminum are few, and those willing require removal, drainage, and disassembly of the lower unit to prevent thermal damage to the nearby seals and bearings. Both conventional repairs are time-consuming, expensive and difficult to accomplish in low population areas where boaters frequently find themselves in need of repairs.

An invention related to the field of boat motor attachments is U.S. Pat. No. 4,995,840 by Seale et al. Seale et al. disclose a fin-shaped attachment which is attached horizontally to a boat motor and is meant to be an extension of the original horizontal appendage. The attachment is intended to enhance the performance of the original boat motor due to its curvature. The curvature of the fin forces the boat motor in the upward direction when a pair of the fin-shaped appendages are attached in their preferred position. Seale et al. do not teach attaching the fin to repair an originally existing appendage, but to enhance the performance of the boat motor.

Zoellner, in U.S. Pat. No. 5,007,869, discloses a device which is attached to the original vertical skeg of a boat motor. Zoellner's device is a vertical sleeve having a horizontal plate attached to its lowest edge. The horizontal plate adds vertical stability to the boat and protection to the propeller. Zoellner's device is attached to a boat motor skeg to prevent damage to the motor and to enhance its performance. In this respect, Zoellner's device is prospective rather than retrospective since its function is to prevent damage to the motor, not to repair the motor after damage. However, since it increases the lowermost dimensions of the motor, it also increases the probability that it will strike a submerged object and cause damage.

Neither Seale et al. nor Zoellner teach a structure for making a repair on a boat motor or replacing an appendage which originally existed but no longer performs as designed. Both of these devices merely affect the original performance of the boat motor, and are intended primarily to increase vertical lift to enhance planing.

BRIEF DISCLOSURE OF INVENTION

A boat motor replacement skeg for replacing a previously existing skeg is fastened to a skeg stub. The skeg stub remains after a skeg portion has been broken off. The improvement comprises a replacement plate having a slot-like cavity formed in one of its edges for receiving a portion of the skeg stub. The replacement preferably seats against the propeller shaft housing and is readily adaptable to all sizes by reduction in size of the device.

Figure 1:
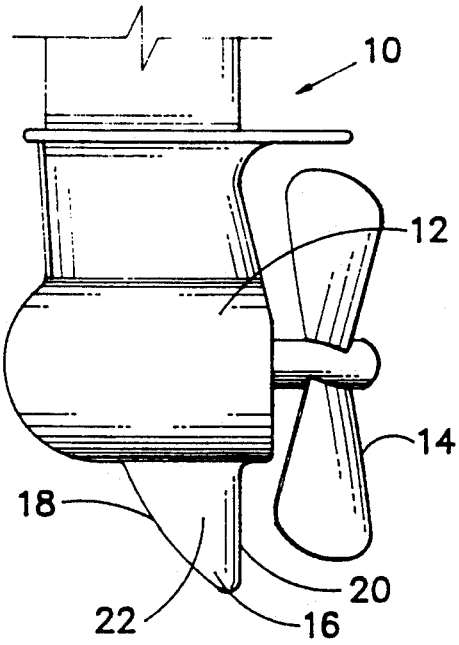
FIG. 1 is a side view illustrating a typical boat motor.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 2:
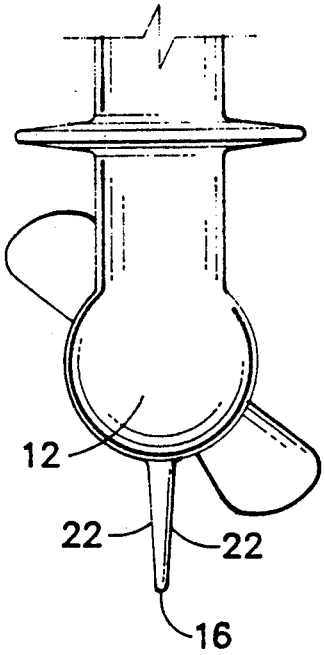
FIG. 2 is a front view of the boat motor of FIG. 1.

A conventional boat motor 10 is illustrated in FIG. 1. The lower section of the motor 10 is made up of a housing 12 which houses a shaft (not shown in FIG. 1) which drives a propeller 14. A fin-shaped skeg 16 is integral with the underside of the housing 12. The skeg 16 has an arcuate frontal region 18, a generally linear rear region 20 and sidewalls 22. As shown in FIG. 2, which is a frontal view of the embodiment of FIG. 1, the sidewalls 22 of the skeg 16 are tapered inwardly. The skeg 16 is wide at the housing 12, and is gradually narrower closer to the bottom. The bottom edge of the skeg 16, as oriented in FIG. 1, is significantly lower than the lowest edge of the propeller 14.

The skeg 16 is typical in shape and size of most skegs. The skeg 16 is representative of the type of skeg on which the present invention can be used. The present invention may be used on boat motor skegs of various sizes and shapes.

Figure 3:
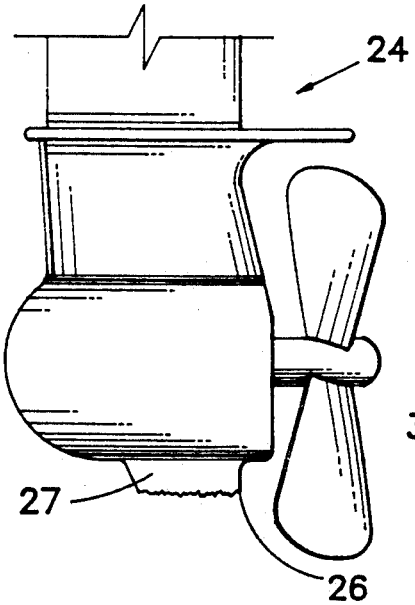
FIG. 3 is a side view illustrating a typical boat motor with a broken skeg.

When the boat motor 10 illustrated in FIGS. 1 and 2 strikes an object, the skeg 16 typically contacts the object before any other part of the motor 10. The impact may cause part of the skeg 16 to be broken off of the boat motor 10. A different boat motor 24 having part of a skeg broken off is shown in FIG. 3. The entire original skeg is rarely completely broken off, so a remaining skeg stub 26 almost always has adequate length to allow mounting of the device.

Figure 4:
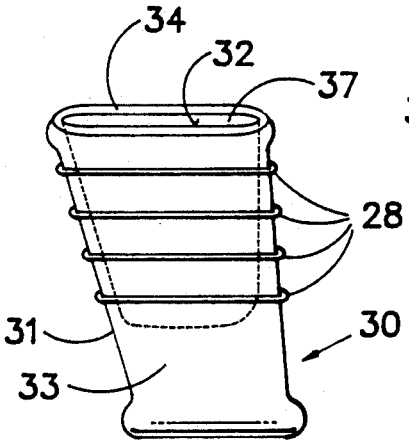
FIG. 4 is a side view illustrating the preferred embodiment of the present invention.
Figure 5:
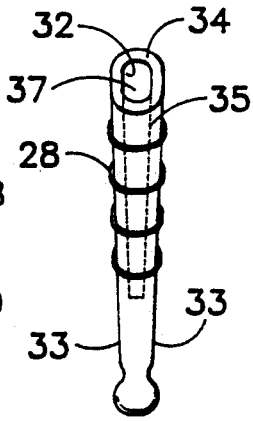
FIG. 5 is a front view of the embodiment of FIG. 4.

A replacement skeg 30, which can be attached to the skeg stub 26 of FIG. 3, is illustrated in FIG. 4 and FIG. 5. The replacement skeg 30 is a generally planar, fin-shaped structure having a rearwardly angled front edge 31 and inwardly tapered exterior sides 33. The shape of the replacement skeg 30 is similar to the skeg of FIG. 1. The replacement skeg 30 is thick enough to have a slot-like cavity 32 formed through its top edge 34 and extending into the interior of the skeg 30. The cavity 32 shown in FIG. 4 and FIG. 5 with hidden lines, has tapered inner surface walls 35 to match the tapered outer sides 27 of the skeg stub 26 shown in FIG. 3. The cavity 32 has sufficient length, width and depth to-contain the skeg stub 26 within it. An elongated aperture 37 is formed in an end of the replacement skeg 30. The top edge 34 and inner surface 35 seat against the outer tapered sides 27 of the skeg stub 26 or preferably the lower propeller shaft housing.

Figure 6:
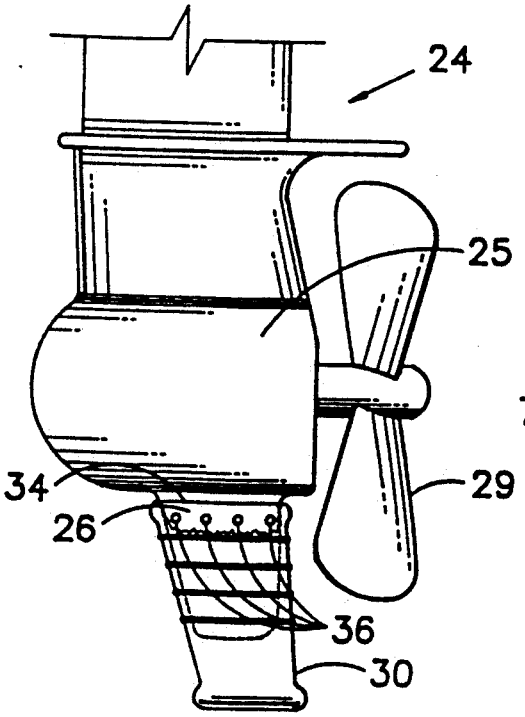
FIG. 6 is a side view illustrating the present invention attached to a typical boat motor.

In FIG. 6, the replacement skeg 30 of FIGS. 4 and 5 is shown attached to the skeg stub 26 of FIG. 3. The preferred method of installing the replacement skeg 30 is as follows. The replacement skeg 30 is slid over the skeg stub 26, extending the skeg stub 26 into the cavity 32 until the top edge 34 and inner surface 35 seat against the outer tapered edges 27. The distance from the lowest extremity of a propeller 29 to the lowest edge of the replacement skeg 3 is measured. The replacement skeg 30 is then removed from the skeg stub 26 and is trimmed to make the distance between the lowest extremity of the propeller 29 to the lowest edge of the replacement skeg 30 approximately one half inch or more.

In the preferred embodiment, before the replacement skeg 30 is fastened to the skeg stub 26, the rough, broken edges of the skeg stub 26 should be smoothed with a file and then silicone sealant is applied to the exterior surface of the skeg stub 26. Next, the replacement skeg 30 is then slid back onto the skeg stub 26 as described above. Several holes 36 are then drilled through the replacement skeg 30 and into the skeg stub 26, aligning the holes 36 when the replacement skeg 30 is in its preferred position. Conventional aluminum pop rivets with washers are then installed through the aligned holes 36. The skeg 30 can alternatively be fastened to the skeg stub 26 with screws or a suitable, strong, waterproof adhesive.

The preferred replacement skeg 30 is made of a plastic which is a combination of nylon and polyethylene. The replacement skeg 30 could alternatively be made of aluminum or any other suitable metal, plastic or other material.

Figure 8:
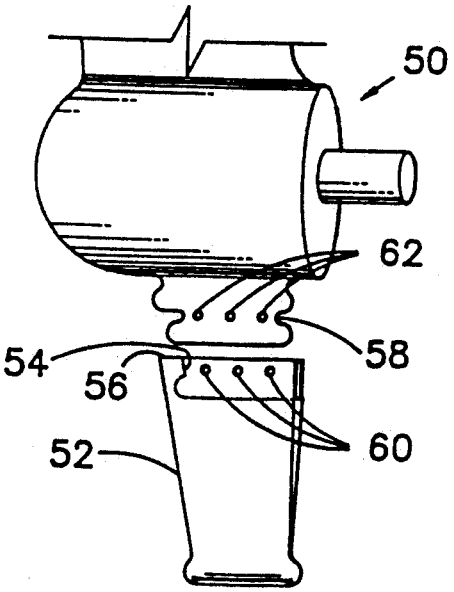
FIG. 8 is a side view illustrating a second alternative embodiment to the present invention.
Figure 9:
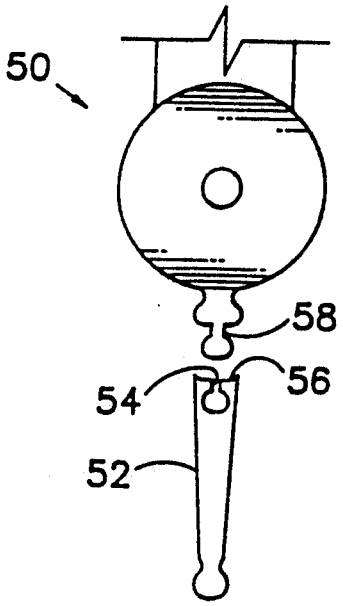
FIG. 9 is a rear view of the embodiment of FIG. 8.

FIG. 8 and FIG. 9 show embodiments of the present invention being used with a boat motor housing 50 designed to utilize a break-away and easily replaced skeg 52. The skeg 52 is originally made with a channel 54 formed in its upper edge 56. The channel 54 is made to slide over and seat against the exterior of a mounting ridge 58 formed on the boat motor housing 50. When assembled, the skeg 52 performs like a conventional skeg, but will break preferentially at the channel 54 so that an identical replacement skeg may be slid and mounted on the unharmed mounting ridge 58. The benefit of this embodiment is that the skeg 52 can be replaced very easily since the replacement skeg 52 is designed to fracture before the mounting ridge 58, leaving behind the mounting ridge 58 on which a new skeg is fastened. Holes 60 are formed through the skeg 52 and corresponding holes 62 are formed through the mounting ridge 58 to permit the attachment of the skeg 52 with screws, bolts or rivets.

Figure 7:
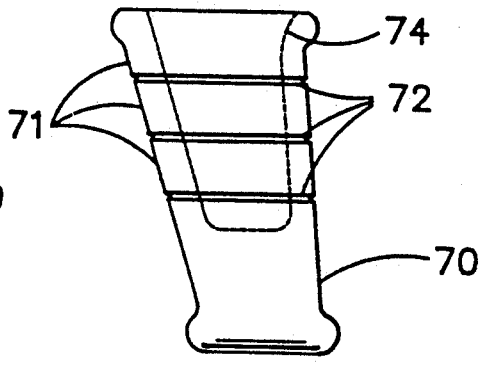
FIG. 7 is a side view illustrating an alternative embodiment of the present invention.

In FIG. 7, an alternative replacement skeg 70 is shown having grooves 72 formed completely around its exterior surface. A cavity 74, shown with hidden lines, is formed as in the preferred embodiment, and extends well beneath all of the grooves 72. The grooves 72 are formed in the skeg 70 to permit trimming and removal of segments 71 of the skeg 70 in order to more easily tailor the skeg 70 to the exact size of a skeg stub. The cavity 74 must extend substantially beyond all of the grooves 72 to permit a skeg stub to extend as far as necessary into the skeg 70, even if all of the segments 71 of the skeg 70 are removed for fitting.

As shown in FIG. 4 and FIG. 5, ribs 28 are formed on the outer surface of the preferred replacement skeg 30. The ribs 28 enhance the structural rigidity of the replacement skeg 30. The ribs also provide reference lines for removal of an upper portion of the replacement skeg to tailor it to the desired replacement skeg length for the particular motor. For example, the upper portion of the replacement skeg may be sawed off immediately above one of the ribs, using the rib as a sawing guide. The uppermost remaining rib then provides a stronger and larger top rim for seating against the enlarged propeller shaft portion of the lower unit. The replacement skeg is preferably cut so that upon assembly around the skeg stub, the replacement skeg will extend approximately one-half to three-quarters of an inch below the path of the outer tip of the propeller.

The size of a replacement skeg is dependent upon the size of the skeg stub. The skeg stub size is substantially dependent upon the size of the original skeg. Motors made by different manufacturers and motors of different horsepower made by the same manufacturer most likely have different sized skegs on them. Ideally, a single replacement skeg would be made that could be attached to virtually any boat motor's skeg stub. However, it is possible to make a plurality of replacement skegs having different exterior dimensions and different interior cavity dimensions for accommodating different boat motor skeg stubs.

It is an object of the present invention to provide a temporary replacement skeg which is attached to the original skeg stub. The replacement skeg should provide performance characteristics similar to the original skeg, with little or no reduction in engine performance due to frictional drag between the exposed edges of the replacement skeg and the water. Additionally, it is an object of the present invention to provide protection of a boat propeller comparable to that of the original skeg due to the lowest edge of the replacement skeg extending beyond the lowest edge of the propeller. The replacement skeg should also kick the motor up in case it strikes an object, while possibly still breaking off just as the preexisting, original skeg did.

While certain preferred embodiments of the present invention have been disclosed in detail, it is to be understood that various modifications may be adopted without departing from the spirit of the invention or scope of the following claims.

I claim:

1. A boat motor replacement skeg for replacing a previously existing skeg on a boat motor lower unit by fastening the replacement skeg to a skeg stub remaining after a portion of the previously existing skeg has been broken off, said skeg stub having a broken lower portion, the replacement skeg comprising:

a plate having a cavity formed within it and defined by cavity walls and an elongated aperture formed in an end of the plate and communicating with the cavity, said cavity for receiving at least a portion of the skeg stub through the aperture and into the cavity, the walls of the cavity formed for surrounding the broken lower portion of the skeg stub.

2. A replacement skeg in accordance with claim 1 wherein the plate is fin-shaped and extends vertically downwardly in an operable position and the cavity is formed on a relatively thicker and wider edge of the plate forming a sleeve for positioning around the exterior of, and fastening to, the skeg stub, and wherein a fastener is provided for attaching the plate to the skeg stub.

3. A plate in accordance with claim 2 wherein the plate is made of aluminum.

4. A plate in accordance with claim 2 wherein the plate is made of a combination of nylon and polyethylene.

5. A plate in accordance with claim 4 wherein the fastener comprises an adhesive.

6. A plate in accordance with claim 4 wherein the fastener further comprises a plurality of screws extending through the plate and into the skeg stub.

7. A plate in accordance with claim 2 wherein the fastener further comprises silicone sealer applied between the skeg stub and the plate, and aluminum pop rivets extending through holes formed in the plate and into holes formed in the skeg stub.

8. A plate in accordance with claim 2 wherein ribs are formed on the exterior of the plate.

9. A plate in accordance with claim 2 wherein grooves are formed in the exterior of the plate to facilitate trimming the plate to fit over the stub stub.

* * * * *